United States Patent [19]

Sturz

[11] 4,455,750

[45] Jun. 26, 1984

[54] DRAFTING TOOL FOR PARALLEL LINES

[76] Inventor: Arthur C. Sturz, 85 Hemlock La., Santa Barbara, Calif. 93111

[21] Appl. No.: 403,078

[22] Filed: Jul. 29, 1982

[51] Int. Cl.[3] ..... B43L 13/02; B43K 27/00

[52] U.S. Cl. ..... 33/43; 33/44

[58] Field of Search ..... 33/41 R, 41 D, 41 F, 33/42, 43, 44, 189, 192

[56] References Cited

U.S. PATENT DOCUMENTS

| | | | |
|---|---|---|---|
| 245,844 | 8/1881 | Low | 33/44 |
| 425,495 | 4/1890 | Demarest | 33/41 D |
| 509,356 | 11/1893 | Bechmann | 33/44 |
| 964,785 | 7/1910 | Johnson | 33/43 |
| 2,551,747 | 5/1951 | Ille | 33/41 D |
| 3,105,305 | 10/1963 | Diffee | 33/189 |
| 3,284,911 | 11/1966 | Clark | 33/43 |
| 3,405,447 | 10/1968 | Pfeffer | 33/41 D |

*Primary Examiner*—Richard R. Stearns
*Attorney, Agent, or Firm*—Harry W. Brelsford

[57] ABSTRACT

A drafting tool is provided to assist in making parallel lines which can be horizontal, vertical or at any angle. The tool has two legs pivoted together and at least one of said legs carries a bar spaced above the drafting paper. The bar carries markers in the form of sharpened metal pins that indent drafting paper, or in the form of writing tips that leave a mark on paper. The bar is resiliently held, and when manually pushed against the drafting paper, the pins indent or the writing tips mark the paper. The draftsman then uses a straight edge to draw lines through the indicia thus made. The pins and writing tips are preferably uniformly spaced in a straight line and the spacing between indicia on the drafting paper with respect to a horizontal or vertical line are variable and are determined by the selected angle between the two legs. Suitable graduations at the pivot can advise the user of the pivot angle to select to obtain the proper indicia spacing with respect to a horizontal or vertical line.

9 Claims, 8 Drawing Figures

Fig. 3
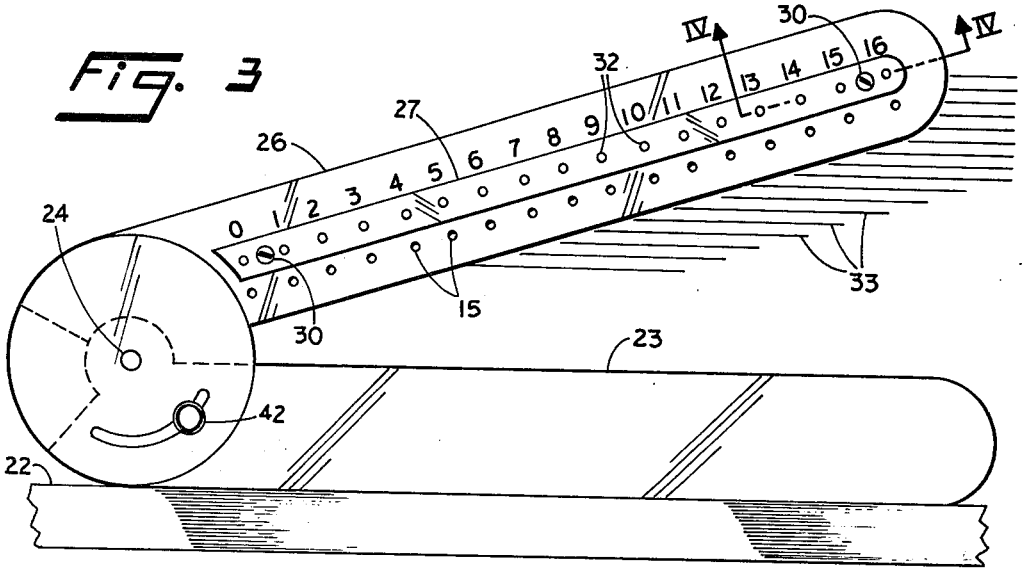
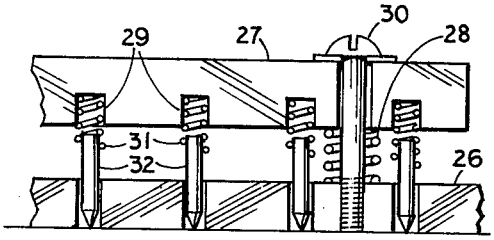
Fig. 4
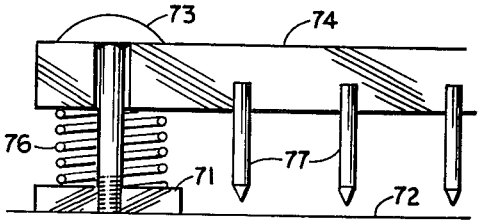
Fig. 8
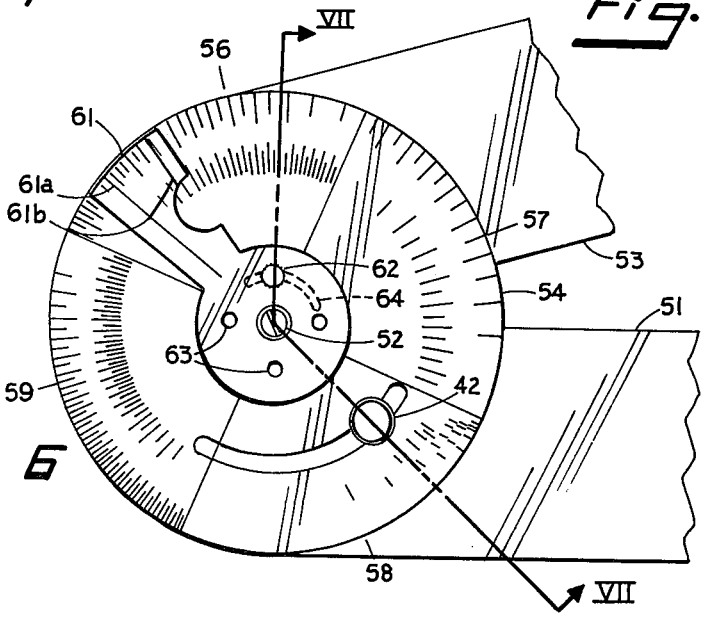
Fig. 6

DRAFTING TOOL FOR PARALLEL LINES

This invention relates to a drafting tool for making parallel lines and has particular reference to a drafting tool for marking parallel lines of selectively different spacings between the parallel lines.

TECHNICAL FIELD

The tool of this invention is used in architectural drafting and other drafting and drawing where large numbers of parallel lines are used. For example, in drawing a building having a brick surface, 20 to 105 horizontal lines are required to show the brick surface detail of a two-story building. Similarly, to realistically portray wood siding or balusters, large numbers of parallel lines are required. When buildings are drawn to different scales, the spacings between lines must be varied depending upon the scale selected.

BACKGROUND OF THE PRIOR ART

Parallel lines have heretofore been made in a variety of techniques, all of which are time-consuming. A calculation is first made of the spacing necessary to depict rows of bricks, for example, and a ruler is next disposed vertically of the paper or other material on which the drawing is made. The dimension is then measured off line-by-line with a sharp pencil. A horizontal straight edge is then lined up successively with the pencil marks and the parallel lines are then drawn. Also a wheel with a spiral arrangment of holes is slid along a straight edge and a pencil point is placed in successive holes to draw a group of parallel lines.

Another technique is to set dividers at the calculated dimension and walk them vertically across the paper. The dividers leave pin pricks in the paper which the draftsman later locates and uses these for the reference points in drawing horizontal parallel lines.

Other techniques employ proportional scalers, especially where no ruler or scale is available for the particular spacing calculated for the spacing between parallel lines.

BRIEF SUMMARY OF THE INVENTION

I have devised a tool having two legs pivoted together to rotate through an angle of zero degree to 90° or more. One leg of the tool remains against the horizontal straight edge of a drafting table or drawing board. The other leg rotates through any desired angle with respect to the stationary leg. The bottom sides of both legs are preferably flat so that they define the plane of the drafting table surface or paper upon which the drawing is to be made. Carried on the rotatable leg is a press bar that is held upwardly of the plane of the table by springs or other resilient members. Projecting from the bar toward the plane are a number of uniformly spaced markers, which can be metal points or writing points. The purpose of the tool is to make a number of marks or indicia on the drafting paper and after these are made the draftsman can place a straight edge successivly at the points or indicia and draw a succession of parallel lines.

To make the marks or indicia on the drawing paper, the draftsman manually pushes down on the bar until the markers contact the paper. The spacing between the marks, with respect to the horizontal straight edge of the table, varies depending upon the angle of the movable leg with the horizontal. The spacing between the mark, along the line of the marks, of course, is uniform. But for small angles of the movable leg, such as 5°, the vertical difference between the markers is tiny, but quite large at 45° and is maximum at 90° where the vertical distance between parallel lines is the same as the spacing between points or markers. The draftsman merely selects the angle of the movable leg and can obtain any desired spacing from zero (0°) to the spacing between markers (90°).

BRIEF DESCRIPTION OF THE DRAWINGS

The invention will be described with reference to the following drawings forming an integral part of this specification and in which:

FIG. 3 is a plan view of the modified form of the tool and is showing a smaller angle wherein the same spacing of markers results in a smaller space between horizontal parallel lines. The tool of FIG. 3 has markers that are writing instruments and by moving the entire tool to the left along a straight edge parallel lines are automatically marked by the tool.

FIG. 4 is a fragmentary sectional view on an enlarged scale along the line IV—IV of FIG. 3 and showing markers in the form of pencil lead secured to a movable bar by means of coil springs.

FIG. 6 is a plan view of the pivot portion of the modified form of the invention wherein there are graduations disposed for separate quadrants, each with a different scale and wherein a pointer secured to the movable leg can be moved to any desired quadrant to utilize the scale of that particular quadrant.

FIG. 8 is a fragmentary elevation view partly in section of a modified form of the device wherein the resilient bar acts as the movable leg for the tool.

Figure 1:
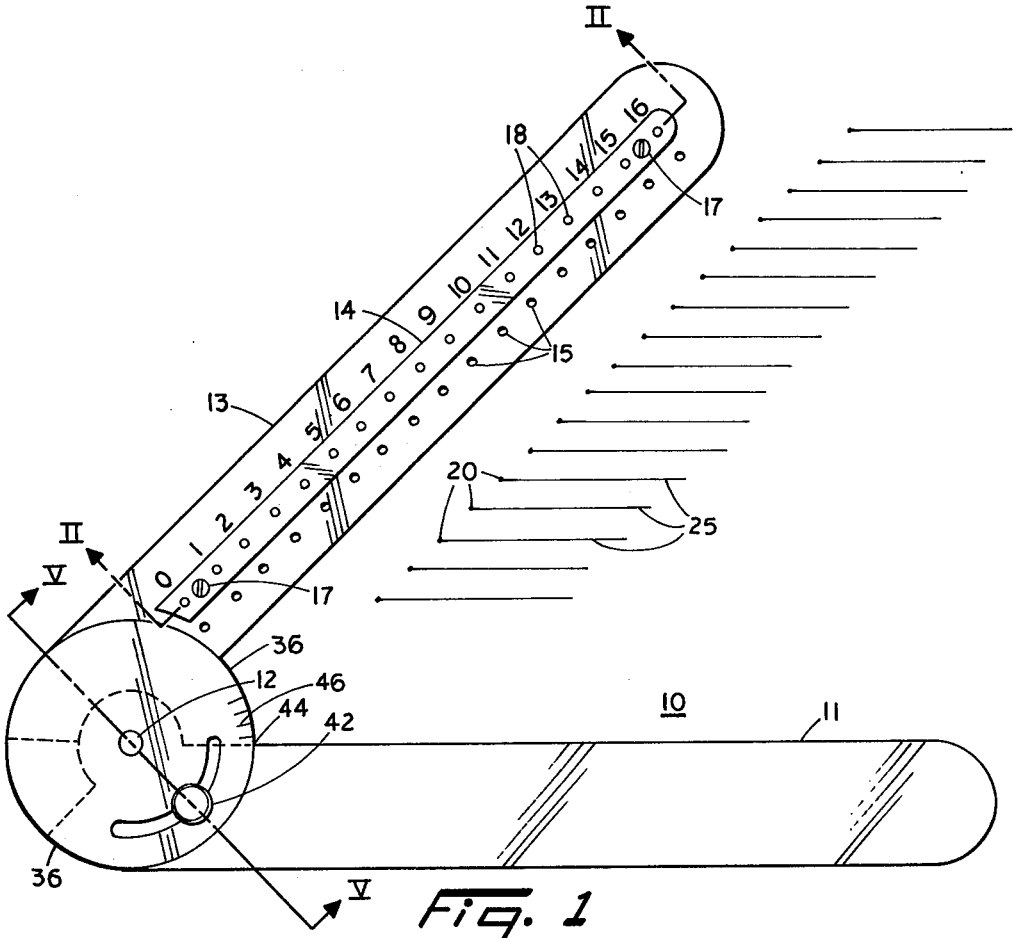
FIG. 1 is a plan view of a presently preferred embodiment of the drafting tool with the upper leg disposed at an angle and moved to the left of a row of marks on drafting paper made with a tool and from which the draftsman has made parallel lines to the right of these marks.
Figure 2:
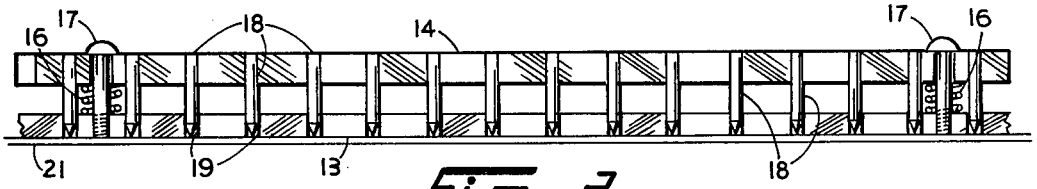
FIG. 2 is a sectional view on an enlarged scale taken along the line II—II of FIG. 1.

Referring FIGS. 1 and 2, the tool is designated generally by the numeral 10 and has a lower leg 11 pivoted at 12 to a rotatable leg 13. The leg 11 generally moves horizontally especially aong a straight edge but from a standpoint of angular movement is normally stationary. Disposed above the leg 13 is a bar 14 that is urged upwardly by compression springs 16 acting between the bar 14 and the leg 13. The upward movement of the bar 14 is restrained by means of screws 17 threaded into the bar 13. Threaded, glued, or otherwise secured to the movable bar 14 is a plurality of metal needles or points 18 preferably uniformly spaced apart. Theses points or markers 18 project through holes 19 in the movable leg 13. When a draftsman manually pushes down on the resiliently biased bar 14 the points or markers 18 move downwardly to indent and will make pin pricks in a sheet of drafting paper 21. This sheet of drafting paper also defines the plane through which the movable leg 13 moves with respect to the stationary leg 11.

Referring now to FIGS. 3 and 4, there is illustrated a straight edge 22 on a drafting table or similar drawing board, and a tool having a stationary leg 23 rides upon this horizontal straight edge 22. Pivoted to the stationary leg 23 at 24 is a movable leg 26 having a bar 27 resiliently spaced from it by means of compression springs 28 and the upward movement of the bar 27 is restrained by screws 30 threaded into the movable leg 26. Formed on the lower surface of the resiliently spaced bar 27 is a plurality of cup-shaped bore holes 29 in which are frictionally forced the upper end of helical springs 31, the bottom end of which grip pieces of pencil lead 32 which are the markers for this embodiment. The lower end of the springs 31 frictionally engage the upper end of the leads 32 to securely hold them against downward movement so that all of the legs 32 are held there retracted from the bottom edge of the movable leg 26.

When the draftsman manually pushes the resiliently held bar 27 downwardly the coil springs 31 force the markers 32 downwardly against any drafting paper or other item to be marked and this impression is left on the paper so that a draftsman can later come along and draw horizontal parallel lines by using his vertically movable straight edge 22; or by placing a 90° triangle against the straight edge 22, can draw vertical parallel lines.

If desired, the markers 32 of FIG. 4 can make parallel lines as shown in FIG. 3 by merely bodily moving the entire tool right or left and there is shown in FIG. 3 movement to the left to generate a plurality of parallel lines 33. Also by moving the straight edge up and down, vertical parallel lines can be drawn.

Figure 5:
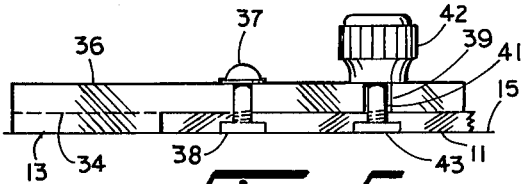
FIG. 5 is a sectional view taken along the line V—V of FIG. 1 showing a thumbscrew for locking the two pivoted legs in any selected angular position.

Illustrated in FIG. 5 are the details of construction of the pivot portion of the tool of FIG. 1. There it will be noted that the two legs 11 and 13 rest upon a plane 15 and the movement of the two legs apart define the plane 15. Glued or otherwise secured to the movable leg 13 at 34 is a round disc 36 which supports a pivot screw 37 engaging a recessed nut 38 in the stationary leg 11. Cut in the disc 36 is a 90° arc slot 39 through which is threaded the shank 41 of the thumbscrew 42. The thread shank 41 engages a recessed nut 43. This thumbscrew 42 enables the two pieces to be held at any selected angle by merely loosening the thumbscrew 42 for angular movement and then tightening the screw 42 to hold the particular angle selected.

Referring to FIG. 1, there will be noted that the disc 36 has graduations 46 which can be read against the upper edge 44 of leg 11 to act as the angle measurement.

Figure 7:
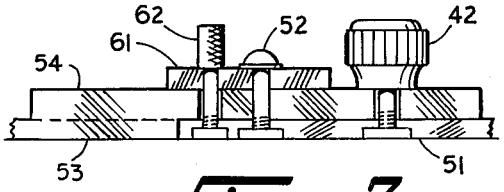
FIG. 7 is a sectional view taken along the line VII—VII of FIG. 6 and showing a smaller thumbscrew to lock the pointer to the stationary horizontal leg of the tool and movable to any selected quadrant.

Illustrated in FIGS. 6 and 7 is a modification of the invention wherein four quadrants of the circular disc may be used as graduations of different scale making the instrument much more versatile. A stationary leg 51 is pivoted by the screw 52 to a movable leg 53. Secured to the movable leg 53 is a disc 54 marked into a plurality of quadrants 56,57, 58 and 59. Held for rotation by the pivot screw 52 is a pointer 61 which is held in any desired location by means of a small thumbscrew 62 threaded into the stationary leg 51. Shown in FIG. 6 is the pointer 61; the thumbscrew 62 is then removed from the device, the pointer rotated to the desired quadrant and the thumbscrew 62 then replaced. This thumbscrew will pass through at 90° arc slot 64 formed in the disc 54. Marked on the pointer 61 is a pointer line 61*a* against which the calibrations or graduations can be read, or they can be read against the line 61*b*. The semi-circular cutout in the pointer gives more movement at the thumbscrew 42.

Shown in FIG. 8 is a modified form of the invention wherein a stationary leg 71 rests upon a plane surface 72 upon which drafting paper or other material may be disposed. Pivoted to this stationary leg 71 by a screw 73 is a vertically movable bar 74 held upwardly by means of a compression spring 76. Projecting downwardly from the bar 74 is a plurality of markers 77. Normally, however, these markers 77 are spaced above the surface 72. When it is desired to mark paper or other writing surface for the making of parallel lines the draftsman manually pushes the bar 74 downwardly against the compression spring 76 whereupon the markers 77 leave their mark on the paper by pin pricks in the paper or as visible writing instrument marks.

OPERATION

The operation of the device of FIGS. 1 and 2 is as follows. The draftsman disposes the stationary leg 11 against a straight edge or other horizontal member on a drafting table and then consults calibrations 46 on the disc 36 at the pivot to determine what spacing he wishes between the markers 18 on the vertically movable bar 14. The desired angle is rotated to by unloosening the thumbscrew 42 of FIG. 5 and rotating the movable leg 13 with respect to the stationary leg 11. The thumbscrew 42 is then tightened to hold the selected angle and the draftsman then manually pushes downwardly on the bar 14 forcing the markers 18 to engage a sheet of paper 21. The device is then moved to the right or left to clear this line of marks as shown as marks 20 in FIG. 1 and parallel lines are then drawn by moving a straight edge to each point 20 and drawing horizontal lines 25 from each point, or vertical lines drawn through each point.

The operation of the device of FIGS. 3 and 4 is as follows. The stationary leg 23 is held against horizontal straight edge 22 or other straight edge on either an inclined drafting table or horizontal drafting table in which case the straight edge 22 will be the edge closest to the draftsman. The proper angle for the device is then selected and the thumbscrew 42 is then tightened to hold the selected angle. In the case of FIG. 4 the markers 32 may be writing instruments and when the bar 27 is moved downwardly these writing instruments 32 or writing points 32 engage the paper or other surface and if the entire device is moved right or left they leave parallel lines. As viewed in FIG. 3, the entire device has been moved to the left whereupon the writing points 32 have left parallel lines 33 on the paper. The entire device may be moved vertically to make vertical parallel lines.

The device of FIG. 8 operates in substantially the same way as the devices of FIGS. 1 and 3. When the proper angle is selected the draftsman merely pushes downwardly on the bar 74 against the compression spring 76 until the markers 77 engage the plane or drawing paper 72.

Shown in FIG. 5 is the thumbscrew 42 which is loosened to permit angular movement between the legs 11 and 13 and which is tightened to hold a particular selected angle.

The operation of FIGS. 6 and 7 is as follows. The pointer 61 has the four holes 63 drilled in it so that the small thumbscrew 62 can be inserted in any one of the holes 63 to dispose the pointer lines 61*a* and 61*b* in any one of the selected quadrants 56, 57, 58 or 59, each of which has a different scale. Each quadrant may have multiple scales against which lines 61*a* and 61*b* are read.

Referring to FIGS. 1 and 3, formed on the movable legs 13 and 26 are holes 15 disposed opposite each marker 18 and 32 respectively. If desired the upper surface of these movable legs may be grooved along the line of these holes 15. The holes 15 enable a draftsman to insert a pencil point in the holes to select every other marker position, every third, every fourth or whatever spacing is desired for making indicia on drafting paper over which parallel lines may be drawn. The material of the legs 11–13 and 23–26 and the discs 36 and 54 is preferably transparent plastic, as well as pointer 61.

The invention has been described with respect to presently preferred embodiments thereof as required by the patent statutes. Numerous variations and modifications will occur to those skilled in the art and there is included within the scope of the following claims all such variations and modifications that fall within the true spirit and scope of the invention.

STATEMENT OF INDUSTRIAL APPLICATION

The device of the patent specification is a drafting tool for use in making parallel lines of variable spacing between different sets of parallel lines. For any one angular setting the spacing between the parallel lines is uniform but the spacing can be increased or decreased by increasing or decreasing the angle of the movable arm with respect to the stationary arm. The device can either make pin pricks or indentations on drafting paper, or it can make visual marks on drafting paper or other surface without actually dimpling or penetrating the paper. The draftsman then merely uses his horizontal straight edge to draw horizontal parallel lines from these marks or other indicia on the paper, and uses a 90° triangle to draw vertical parallel lines through these same marks. The device of FIG. 3 may be bodily moved horizontally to make horizontal lines as shown in FIG. 3 or may be bodily moved vertically to make vertical lines. The device may make marks for horizontal parallel lines or vertical lines without rotating the tool through 90°.

I claim:

1. A drafting tool for marking parallel lines at variable spacings between the lines comprising:

(a) a pair of legs pivoted together for movement through an arc, one of said legs normally being stationary and the other moving through said arc, said arc movement defining a plane;

(b) a bar carried by said other leg;

(c) means for securing the bar to said other leg with movement toward and away from said plane;

(d) resilient means engaging the bar and said other leg to normally urge the bar away from said plane;

(e) and a plurality of markers carried by said bar and normally spaced from the plane, whereby manual movement of the bar toward the plane will cause the markers to engage the plane to leave indicia.

2. A drafting tool as set forth in claim 1 wherein the markers are pins that indent the surface of the plane.

3. A drafting tool as set forth in claim 1 wherein the markers are writing points that leave indicia on the surface of the plane.

4. A drafting tool as set forth in claim 1 wherein the movable leg is perforated with holes and the markers project through the holes when the bar is manually moved toward the plane.

5. A drafting tool as set forth in claim 1 wherein graduations are marked at the region of the pivot of the two legs to indicate various angles and thereby various spacings for parallel lines.

6. A drafting tool as set forth in claim 1 wherein a lock selectively engages the two legs to hold them at any selected angle in the arc of movement.

7. A drafting tool as set forth in claim 1 wherein the region of the pivot is graduated in sectors of different scales, and a pointer is selectively secured to one of the arms to indicate the selected graduations of a selected sector.

8. A drafting tool for marking parallel lines on a surface at variable spacings between the lines comprising:

(a) a stationary leg adapted to rest on the surface;

(b) a bar pivoted to the leg;

(c) markers projecting from the bar toward the surface;

(d) and means for resiliently spacing the bar from the surface, whereby a manual pressing of the bar toward the surface will overcome the resilient means and cause the markers to make indicia on the surface.

9. A drafting tool as set forth in claim 1 wherein resilient means connects the markers to the bar.

* * * * *